United States Patent [19]

Druitt

[11] Patent Number: 4,629,083

[45] Date of Patent: Dec. 16, 1986

[54] CLOSURE WITH RESILIENT SEALING DISC

[75] Inventor: Rodney M. Druitt, Collaroy, Australia

[73] Assignee: Bev-Cap Plastics Pty. Ltd., New South Wales, Australia

[21] Appl. No.: 713,399

[22] PCT Filed: Jun. 22, 1984

[86] PCT No.: PCT/AU84/00114

§ 371 Date: Feb. 21, 1985

§ 102(e) Date: Feb. 21, 1985

[87] PCT Pub. No.: WO85/00154

PCT Pub. Date: Jan. 17, 1985

[30] Foreign Application Priority Data

Jun. 23, 1983 [AU] Australia ..... 16165/83

[51] Int. Cl.[4] ..... B65D 53/04

[52] U.S. Cl. ..... 215/329; 215/350

[58] Field of Search ..... 215/350, 351, 341, 329

[56] References Cited

U.S. PATENT DOCUMENTS

| | | | |
|---|---|---|---|
| 910,128 | 1/1909 | Hammer | 215/351 X |
| 3,006,493 | 10/1961 | Acton | 215/350 X |
| 3,122,254 | 2/1964 | Hagmann et al. | 215/351 X |
| 3,207,350 | 8/1965 | Hagmann et al. . | |
| 4,034,882 | 7/1977 | Wright . | |
| 4,076,152 | 2/1978 | Mumford | 215/350 |
| 4,462,502 | 7/1984 | Luenser et al. | 215/350 |

FOREIGN PATENT DOCUMENTS

| | | | |
|---|---|---|---|
| 148565 | 10/1952 | Australia . | |
| 164339 | 7/1955 | Australia | 215/343 |
| 52206/79 | 5/1980 | Australia . | |
| 850871 | 9/1939 | France | 215/351 |
| WO82/02182 | 7/1982 | PCT Int'l Appl. . | |
| 683521 | 12/1952 | United Kingdom | 215/350 |

*Primary Examiner*—Donald F. Norton

*Attorney, Agent, or Firm*—Stiefel, Gross, Kurland & Pavane

[57] ABSTRACT

A thermoplastic closure comprising a top wall and an internally threaded skirt and adapted to receive a resilient sealing disc in which an annular flexible protrusion depends from the inner side of the top wall adjacent the intersection of the top wall and skirt but spaced from the skirt. As the closure is applied to a container neck the protrusion acts to fold the periphery of the sealing disc over the outer edge of the container neck and onto the outer side surface and radius of the container neck to thereby effect a seal.

7 Claims, 2 Drawing Figures

CLOSURE WITH RESILIENT SEALING DISC

The present invention relates to a thermoplastic pre threaded screw closure for an externally threaded bottle neck and of the type utilising soft resilient circular liners or discs to provide a positive hermetic seal thus preventing liquid and gas loss in carbonated beverage containers. Such screw closures are generally known and used for beverages containing carbon dioxide.

A sealing liner, held in place inside such closures between the intersection of the top and downward protruding sidewall is essential for provision of a positive seal after the closure has been first applied and after re-closing. This type of sealing medium also allows easy removal of the cap.

Any seal on the top alone of a container neck is not sufficiently positive as when pressure is developed inside the container the circular top wall of the closure lifts due to the flexibility of the thermoplastic material. In lifting, some top seal is lost, thus increasing the chance of pressure and liquid loss. It is therefore necessary to provide a seal either in the bottle bore or preferably on the top sealing surface to outside neck wall radius and down the vertical sidewall. In the case of glass finishes the outside wall tolerances are considerable and the neck top to sidewall intersection radius is subject to manufacturing variations thus making it difficult to design a closure to co-operate with this intersection and provide a side seal.

The object of this invention is to ameliorate one or more of the problems of the prior art by providing a pre threaded screw closure with an adequate top and side seal. The invention discloses a thermoplastic closure adapted for use with a container having an externally threaded neck opening. The closure has a pre formed thread of at least one radial turn which engages with the externally threaded bottle neck.

Inside the closure there is a downward extending protrusion from the top wall which forces a soft resilient circular liner against the top and side of the bottle neck or finish in order to provide a positive seal. It is important that the protrusion is from the top wall as the protrusion is radially laterally flexible and will allow for inherent variation in the sealing liner thickness.

Figure 1:
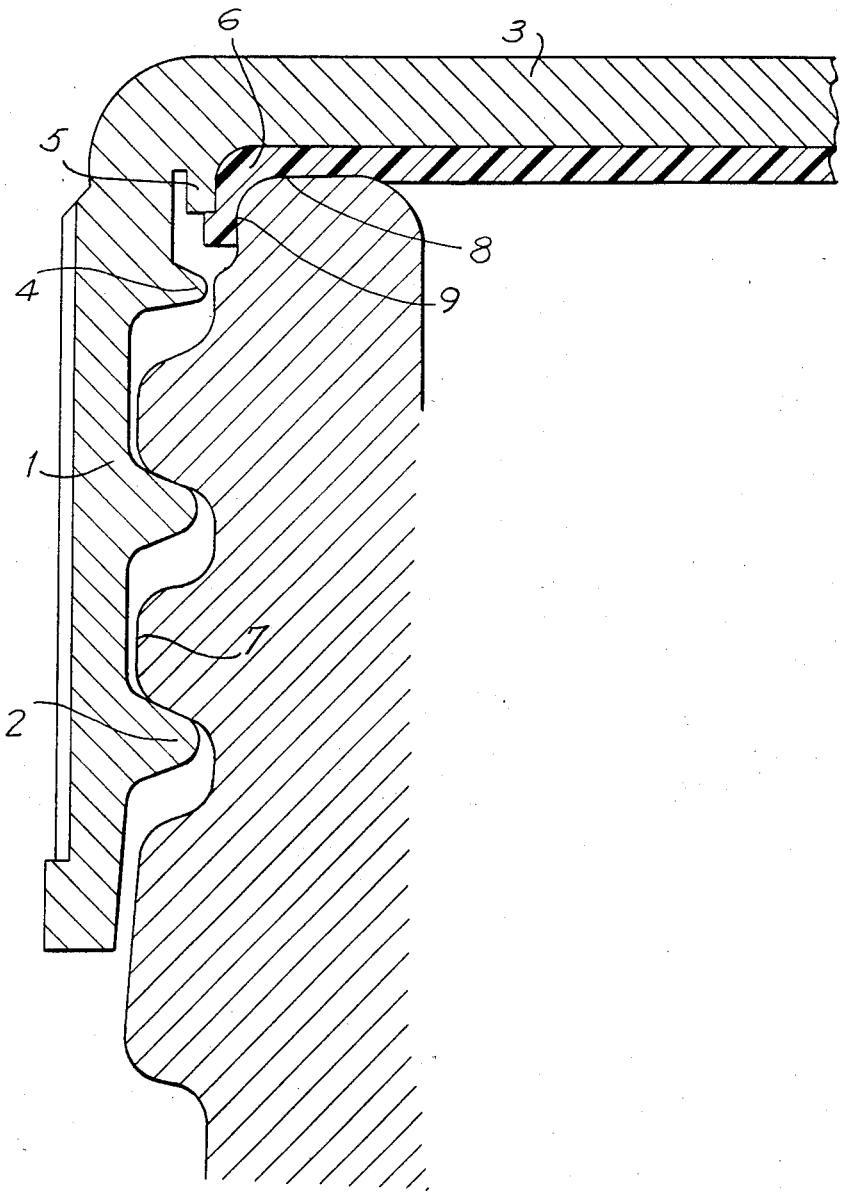

One embodiment of the present invention is disclosed in FIG. 1 being a part radial section through a closure in accordance with the present invention in sealing relationship with the bottle neck.

Figure 2:
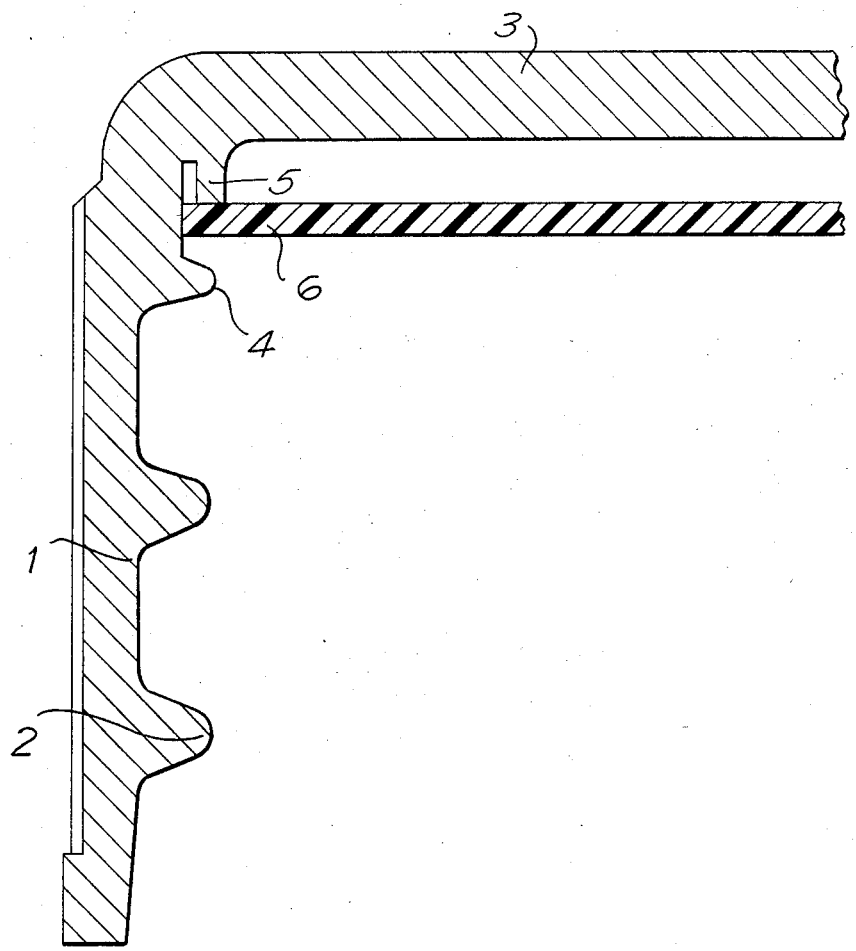

FIG. 2 depicts the same closure before application to a bottle.

According to FIG. 1 the closure is provided with an annular skirt (1) with an internally pre threaded section (2). The circular top wall (3) is integral with the skirt and has a protrusion (5) depending downwardly therefrom. Disc retaining means (4) are shown in the form of an annular flange extending inwardly from the skirt's inner wall. The thread (2) is in engagement with corresponding thread (7) on the bottle neck and the protrusion (5) has forced the periphery of the disc (6) down past the top of the bottle neck (8) onto the side surface and radius (9) of the bottle neck thus effecting a side seal. The downward extending protrusion defines a gap between itself and the closure skirt. Preferably the protrusion (5) is flexible and can therefore move radially thereby allowing for inherent variation in the thickness of disc (6).

The claims defining the invention are as follows:

1. A thermoplastic closure system comprising a closure with an internally threaded skirt of the type adapted to receive a resilient sealing disc, a resilient sealing disc, the closure having a continuous annular flexible protrusion depending from the inside top wall adjacent the top wall/skirt intersection, spaced from the skirt and having its lower inside shoulder shaped so as to be capable of folding and drawing the periphery of said resilient sealing disc around a closure neck and down its outside side wall thus effecting a seal.

2. A closure as in claim 1 wherein the protrusion is substantially rectangular in radial section.

3. A closure in accordance with claim 2 made from polypropylene and adapted to be used with a disc manufactured from ethylene vinyl acetate.

4. A closure as in claim 2 having a disc retaining flange extending radially inwardly from the skirt below the lower extremity of the protrusion.

5. A closure in accordance with claim 1 made from polypropylene and adapted to be used with a disc manufactured from ethylene vinyl acetate.

6. A thermoplastic closure with an internally threaded skirt of the type adapted to receive a resilient sealing disc, the closure having a continuous annular flexible protrusion depending from the inside top wall adjacent the top wall/skirt intersection, spaced from the skirt and adapted to fold the periphery of a resilient sealing disc around a closure neck and down its outside wall thus affecting a seal, a disc retaining flange extending radially inwardly from the skirt below the lower extremity of the protrusion.

7. A closure in accordance with claim 6 made from polypropylene and adapted to be used with a disc manufactured from ethylene vinyl acetate.

* * * * *